US009211048B2

(12) United States Patent
Bennett

(10) Patent No.: US 9,211,048 B2
(45) Date of Patent: Dec. 15, 2015

(54) DAMPENED PUMP ASSEMBLY FOR A DISHWASHER

(75) Inventor: Aaron P. Bennett, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1366 days.

(21) Appl. No.: 13/009,906

(22) Filed: Jan. 20, 2011

(65) Prior Publication Data

US 2012/0186611 A1 Jul. 26, 2012

(51) Int. Cl.
*A47L 15/42* (2006.01)
*F04D 29/66* (2006.01)

(52) U.S. Cl.
CPC ..... *A47L 15/4225* (2013.01); *F04D 29/669* (2013.01)

(58) Field of Classification Search
CPC ..... F04D 29/669; A47L 15/4225
USPC ..... 134/56 D, 184, 186
See application file for complete search history.

(56) References Cited

U.S. PATENT DOCUMENTS

| | | | | | |
|---|---|---|---|---|---|
| 2,342,995 | A | * | 2/1944 | Ballentine | 134/186 |
| 3,963,046 | A | * | 6/1976 | Bergeson | 137/565.17 |
| 4,221,547 | A | * | 9/1980 | Hoffman et al. | 417/363 |
| 5,174,318 | A | * | 12/1992 | Dingler et al. | 134/188 |
| 6,141,995 | A | * | 11/2000 | Johnson | 68/3 R |
| 2004/0055410 | A1 | | 3/2004 | Rosenbauer et al. | |
| 2010/0024851 | A1 | | 2/2010 | Rockwell et al. | |

FOREIGN PATENT DOCUMENTS

WO 0022220 A1 4/2000

* cited by examiner

*Primary Examiner* — Michael Barr
*Assistant Examiner* — Benjamin L Osterhout

(57) ABSTRACT

A dishwasher incorporates a dampened pump assembly including a housing having a base to which is mounted a pump and motor unit configured to develop a flow of washing fluid during operation of the dishwasher. A mass damper is mounted to the housing, with the mass damper substantially conforming to the shape, directly abutting and being rigidly fixed to a portion of the housing at a position offset from the pump and motor unit. The mass damper provides added weight, generally in the order of 1-6 lbs, to the pump assembly which reduces vibrations throughout the dishwasher caused by operation of the pump and motor unit.

20 Claims, 6 Drawing Sheets

DAMPENED PUMP ASSEMBLY FOR A DISHWASHER

BACKGROUND OF THE INVENTION

1. Field of the Invention

The present invention pertains to the art of dishwashers and, more particularly, to a dampened pump assembly for a dishwasher.

2. Description of the Related Art

Certainly, it is desirable to produce a dishwasher which is quiet in operation. To this end, it is known in the art of dishwashers to utilize insulation and other barriers to reduce low frequency noises generated during the operation of motors for fluid recirculation and drain pumps. It is also known to attach freely oscillating mass components to a motor via elastic linkage components for damping the vibrations of the motor, such as discussed in U.S. Patent Application Publication No. 2004/0055410. Such oscillating mass components need to be tuned to a specific resonant frequency corresponding to specific motor vibrations. Initially, such an arrangement is quite effective but, in addition to being rather complicated and expensive to produce, generally requires re-tuning over time to remain effective. There also exist other solutions to noise reduction, with these solutions having varying levels of success in the reduction of noises emanating from dishwashers due to the operation of fluid pumps and drain motors. Regardless, there is still seen to be a need for an extremely cost effective, robust and efficient noise reduction arrangement for a dishwasher.

SUMMARY OF THE INVENTION

The present invention is directed to the inclusion of a mass damper on a pump assembly of a dishwasher in order to reduce vibrations, generated by the dishwasher pump, in a broad frequency range. More specifically, a dishwasher in accordance with the invention incorporates a dampened pump assembly including a housing having a base to which is mounted a pump and motor unit configured to develop a flow of washing fluid during operation of the dishwasher. A mass damper is mounted to the housing, with the mass damper substantially conforming to the shape and being rigidly fixed to a portion of the housing at a position offset from the pump and motor unit. The mass damper provides added weight to the pump assembly which reduces vibrations throughout the dishwasher caused by operation of the pump and motor unit.

In accordance with preferred embodiments of the invention, the base of the pump assembly also forms part of a sump unit, including a sump enclosure. The mass damper takes the form of a housing which extends over and about the sump enclosure. Exposed to the sump enclosure are ports which are fluidly connected to a recirculation pump unit and a drain pump unit respectively. With this arrangement, the mass damper housing adds a significant amount of weight at the sump enclosure where vibrations can be generated due to turbulent fluid flow there through, while also being effectively offset from the recirculation and drain pump units in order to provide a more stable center of gravity.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENTS

Figure 1:
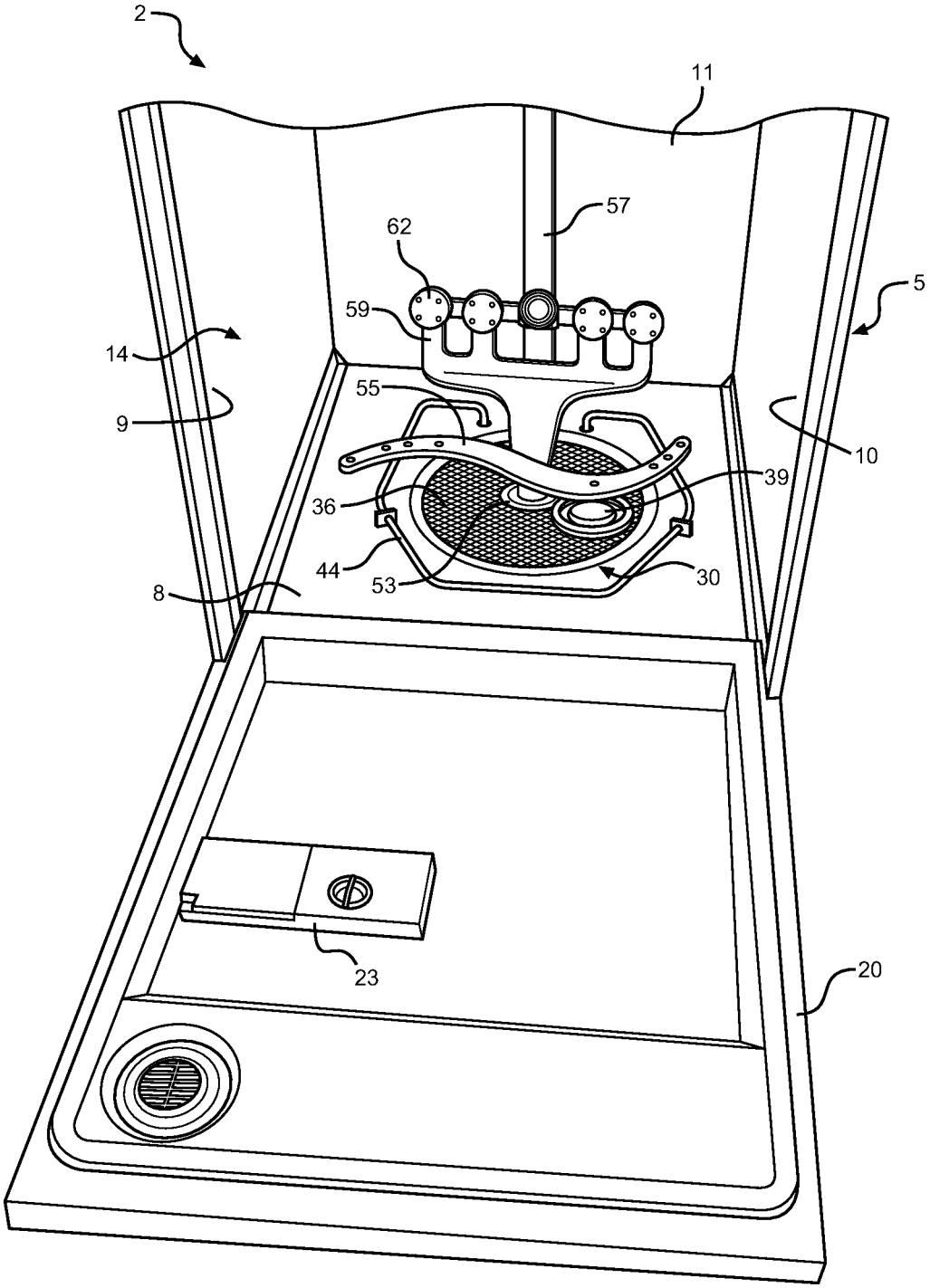
FIG. 1 is a perspective view of a dishwasher including the dampened pump assembly of the invention.

With initial reference to FIG. 1, a dishwasher constructed in accordance with the present invention as generally indicated at 2. As shown, dishwasher 2 includes a tub 5 which is preferably molded of plastic so as to include integral bottom, side, and rear walls 8-11 respectively, as well as a top wall (not shown). Tub 5 defines a washing chamber 14 within which soiled kitchenware is adapted to be placed upon shiftable upper and lower racks (not shown), with the kitchenware being cleaned during a washing operation in a manner widely known in the art. Tub 5 has attached thereto a pivotally supported door 20 used to seal chamber 14 during the washing operation. In connection with the washing operation, door 20 is preferably provided with a detergent tray assembly 23 within which a consumer can place liquid or particulate washing detergent for dispensing at a predetermined portion of the washing operation. Of course, dispensing detergent in this fashion is known in the art such that this arrangement is only being described for the sake of completeness.

Disposed within an opening (not labeled) of tub 5 is a pump and filtration assembly generally indicated at 30. In the preferred embodiment, pump and filtration assembly 30 includes a central main strainer or filter screen 36 and a secondary, fine strainer 39. Extending about a substantial portion of pump and filtration assembly 30, at a position raised above bottom wall 8, is a heating element 44. In a manner known in the art, heating element 44 preferably takes the form of a sheath, electric resistance-type heating element.

Dishwasher 2 further includes a water distribution manifold indicated at 53. In a manner known in the art, water distribution manifold 53 supplies washing fluid to at least a lower wash arm 55 and a conduit 57 leading to an upper spray arm (not shown). Additionally, water distribution manifold 53 may be in fluid communication with a spray manifold assembly 59 including a plurality of spray discs 62. The manner in which wash arm 54 and spray manifold assembly 59 are utilized is known in the art, such that this structure will not be described further herein. Certainly, during operation of pump and filtration assembly 30, vibrations will be generated. The present invention is specifically directed to dampening these vibrations as will be detailed below.

Figure 2:
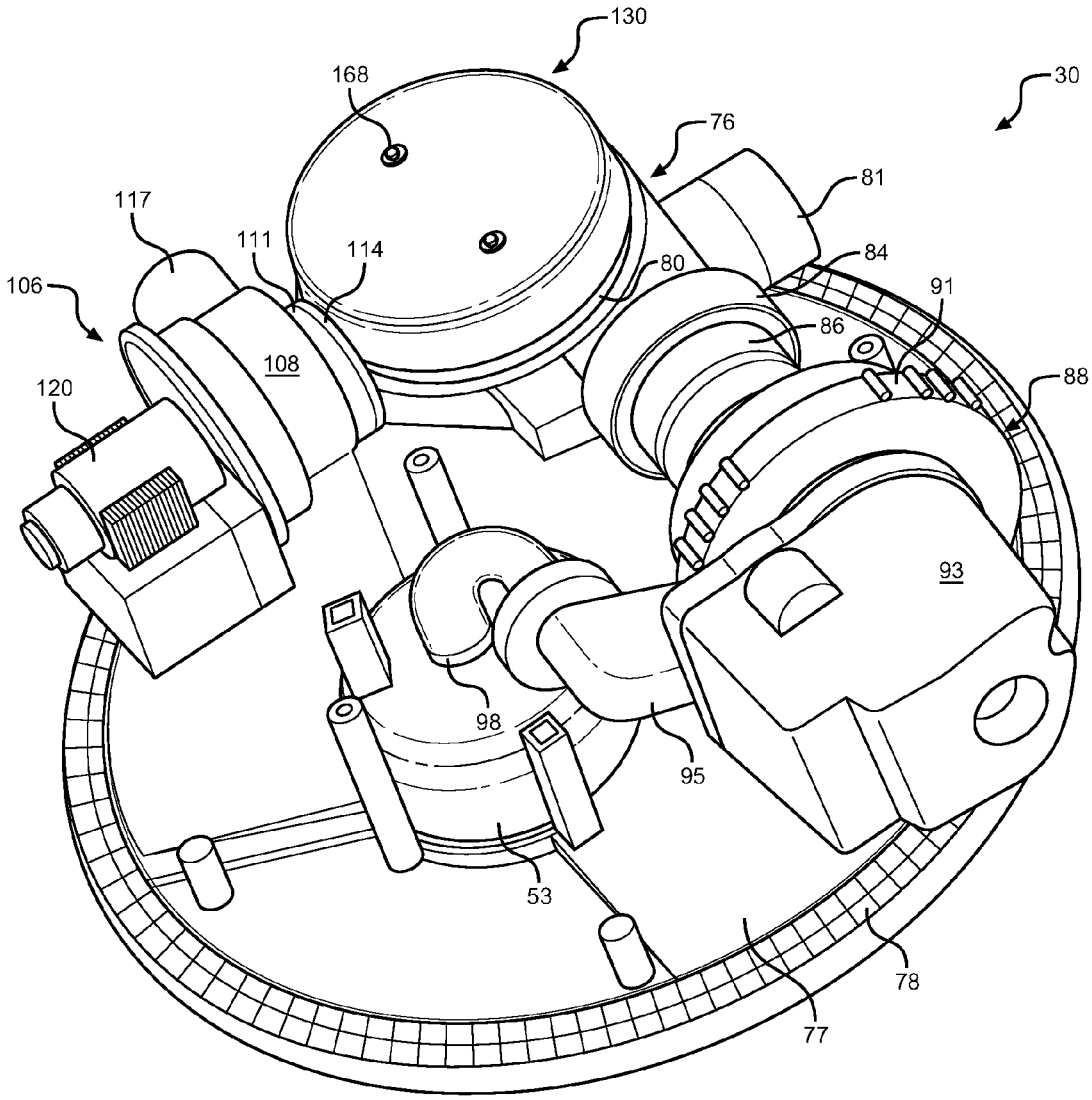
FIG. 2 is bottom perspective view of a dampened pump assembly constructed in accordance with a first embodiment of the invention.

With reference to FIG. 2, pump and filtration assembly 30 includes an integrally formed sump unit 76 including a main body or base 77 having an outer circumferential edge 78 of over which filter screen 36 is disposed. Sump unit 76 also includes a sump enclosure 80 having a main intake 81 which is adapted to receive a supply of fresh water for washing operations within dishwasher 2. Sump enclosure 80 also has associated therewith an outlet 84 or first mounting port defining a fluid conduit that is integrated into main body 77 and connected to an inlet conduit 86 of a circulation pump unit 88. Circulation pump unit 88 includes a pump portion 91 which is driven by a motor portion 93. Circulation pump unit 88 also includes an outlet conduit 95 which leads to an inlet 98 of water distribution manifold 53.

As also shown in this figure, pump and filtration assembly 30 also includes a drain pump unit 106 including a pump portion 108 having an inlet conduit 111 connected to an outlet 114 or second mounting port of sump enclosure 80. Pump portion 108 of drain pump unit 106 also includes an outlet conduit or drain 117. Finally, drain pump unit 106 also includes an electric motor 120 for driving pump portion 108.

In a manner known in the art, dishwasher 2 can operate to wash dishware by activating a washing cycle wherein water will be directed into main intake 81 in order to fill sump enclosure 80 and a lower portion of tub 5. At the same time, the water will flow into circulation pump unit 88 and water distribution manifold 53. During a normal washing operation, circulation pump unit 88 is activated to draw washing fluid from sump enclosure 80 through outlet 84 and inlet conduit 86, while directing the washing fluid through outlet conduit 95, water distribution manifold 53 and then to wash arm 55, conduit 57 and manifold assembly 59. When the overall washing cycle calls for a drain operation, circulation pump unit 88 is deactivated and drain pump unit 106 is operated to cause fluid to be drawn from sump enclosure 80 through secondary outlet 114 and inlet conduit 111, with the water being discharged through drain 117. Again, this overall operation of dishwasher 2 is known in the art and is presented for the sake of completeness. Most importantly, in connection with the present invention is the fact that operation of circulation pump unit 88 and/or drain pump unit 106 during an overall washing cycle will generate vibrations which attenuate into tub 5 and result in undesirable noises emanating from dishwasher 2. To minimize these vibrations and counter the potential noise generation, pump and filtration assembly 30 in accordance with the present invention is provided with a mass damper housing 130 mounted about sump enclosure 80. FIGS. 2-5 illustrate a first preferred embodiment of the invention and specific reference will now be made to FIGS. 3-5 in disclosing the preferred construction of mass damper housing 130.

Figure 3:
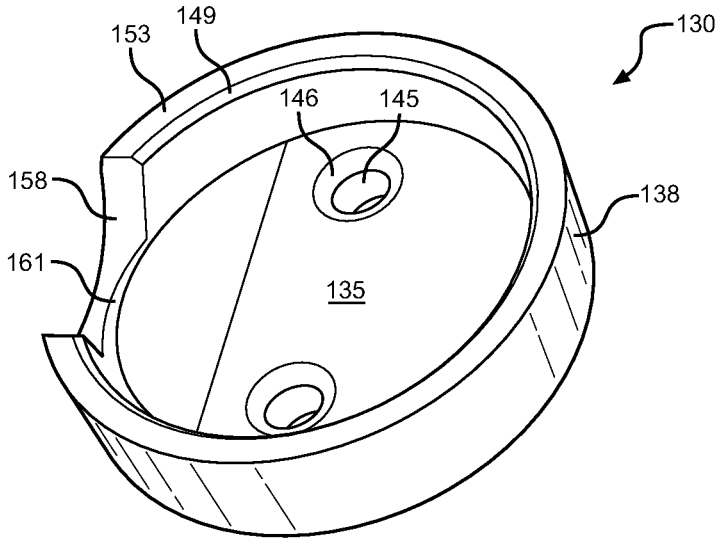
FIG. 3 is a perspective view of a mass damper housing according to the first embodiment.
Figure 4:
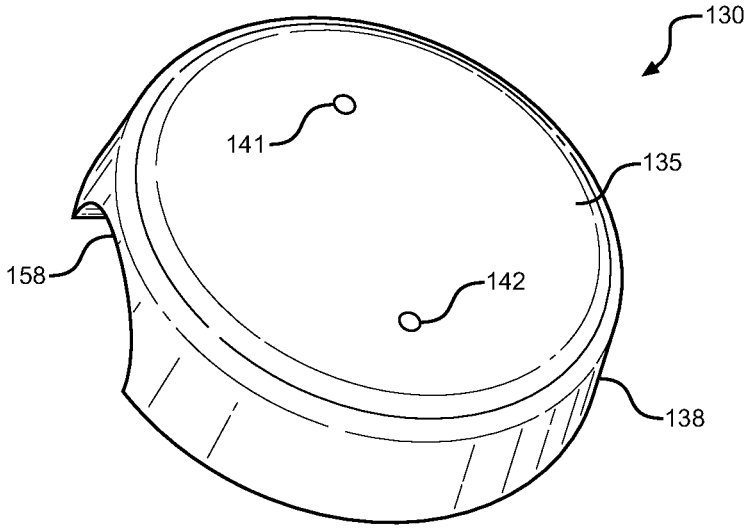
FIG. 4 is another perspective view of the mass damper housing of FIG. 3.
Figure 5:
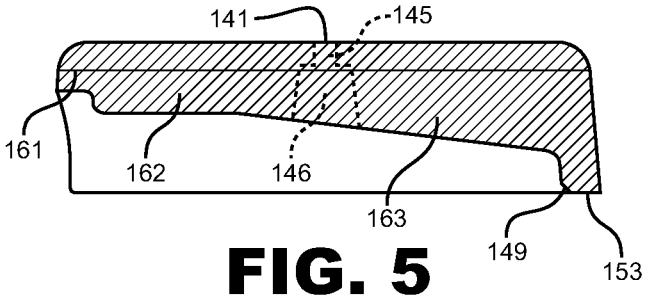
FIG. 5 is a cross-sectional view of the mass damper housing of FIGS. 3 and 4.

As shown in these figures, mass damper housing 130 includes a base 135 and a peripheral side wall 138. Arranged in base 135 is a pair of spaced bores 141 and 142. As illustrated, each of bores 141 and 142 is preferably formed with a first, uniform diametric portion 145 which leads to a second, enlarged and tapering diametric portion 146. In addition, the portion of peripheral side wall 138 remote from base 135 is provided with a beveled edge 149 leading to a terminal edge 153. Along a portion of peripheral side wall 138 is formed an arcuate cut-out portion 158 for reasons which will be discussed more fully below. Finally, in the embodiment depicted, base 135 is actually formed with various, varying thickness portions including a first thickness portion 161, a second thickness portion 162 and a third, varying thickness portion 163. As best illustrated in FIGS. 3 and 5, second, tapered diametric portion 146 of each of bores 141 and 142 is exposed at third varying thickness portion 163.

As clearly shown in FIG. 2, mass damper housing 130 is fitted upon sump enclosure 80 and fixedly and rigidly secured thereto by means of fasteners 168 extending through bores 141 and 142 and into posts (not shown) projecting from sump enclosure 80 into tapering diametric portions 146. In accordance with the invention, it is highly desirable to have mass damper housing 130 conform to the shape of the structure to which it is mounted, as well as any directly adjacent structure of sump unit 76. It is for this reason that this preferred embodiment of mass damper housing 130 is provided with the structure described above including arcuate cut-out portion 158 which extends about and closely conforms to secondary outlet 114, as well as the inclusion of the various different thickness portions 161-163 which conforms to the shape and structure of sump enclosure 80. Therefore, at this point, it is important to note that mass damper housing 130 is molded or cast to conform to and actually directly abut the structural configuration of a portion of pump and filtration assembly 30, specifically sump enclosure 80 in the embodiment depicted, while also not extending too far below tub 5 and base 77 such that base 135 of mass damper housing 130 will remain off a floor surface which supports dishwasher 2, such as a kitchen floor in a household. It is also important to note that mass damper housing 130 defines a mass damper, rather than a tuned damper, and therefore has considerable weight generally in the range of 1-6 lbs. and, in the preferred embodiment shown in these figures, approximately 2-3 lbs. This added mass not only lowers the center of gravity but also preferably concentrates the center of gravity in connection with overall pump assembly 30 at a position offset from both circulation pump unit 86 and drain pump unit 106. Mass damper housing 130 can actually be formed of various materials, with the embodiment shown in FIGS. 2-5 being formed of scrap cast iron in order to establish the target weight. This inclusion of the larger weight has been found to effectively reduces the generation of vibrations, particularly throughout a 60-180 Hz range, both vertically and side-to-side. Therefore, as any generated vibrations would attenuate into tub 5 and create noise, the inclusion of mass damper housing 130 and the conformance and rigid fixing thereof to the structure in which it is mounted significantly lowers vibrations in general, thereby minimizing the generation of noise during operation of circulation pump unit 88 and/or drain pump unit 106 as will be more detailed below.

Figure 6:
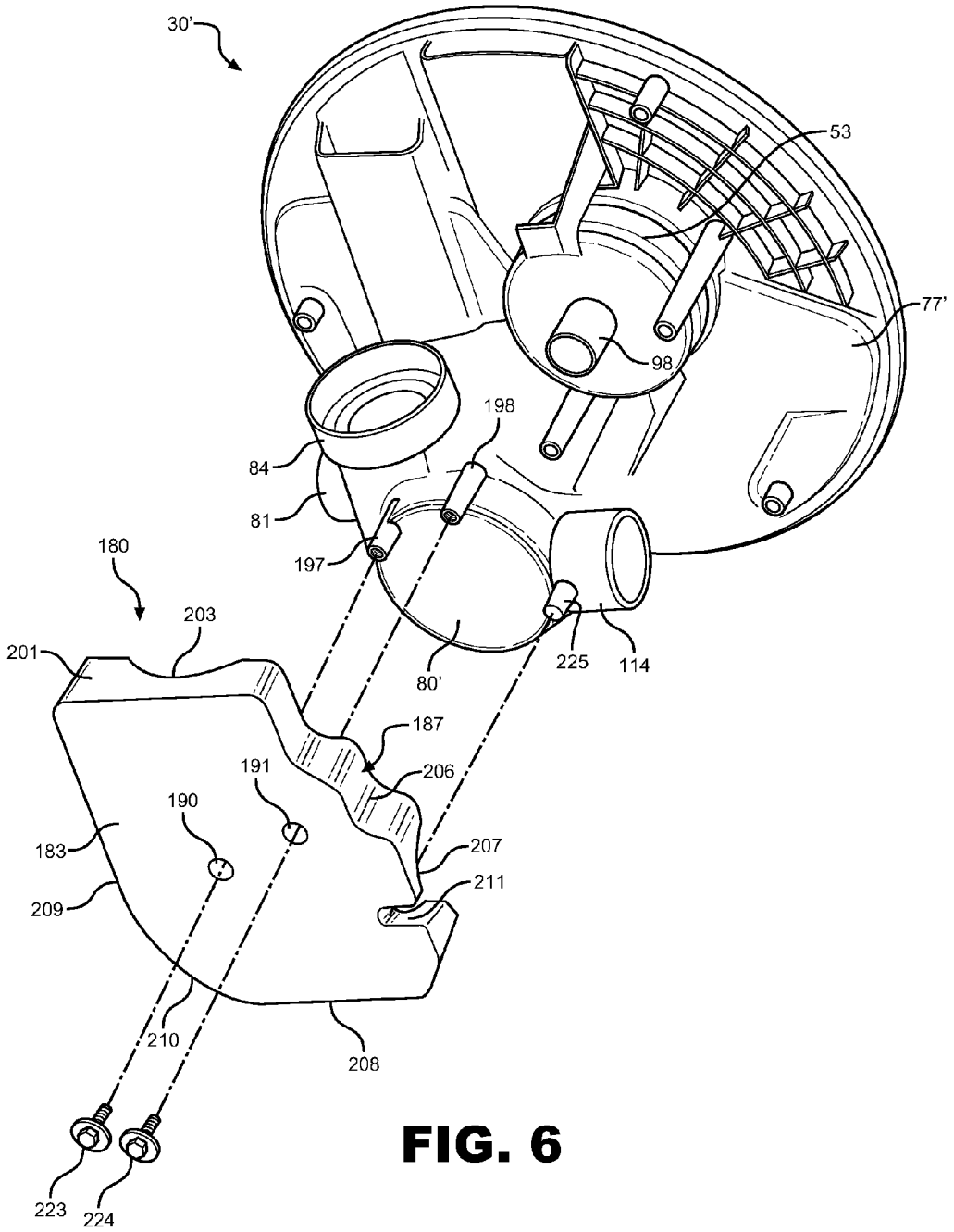
FIG. 6 is an exploded view of a dampened pump assembly constructed in accordance with a second embodiment of the invention.
Figure 7:
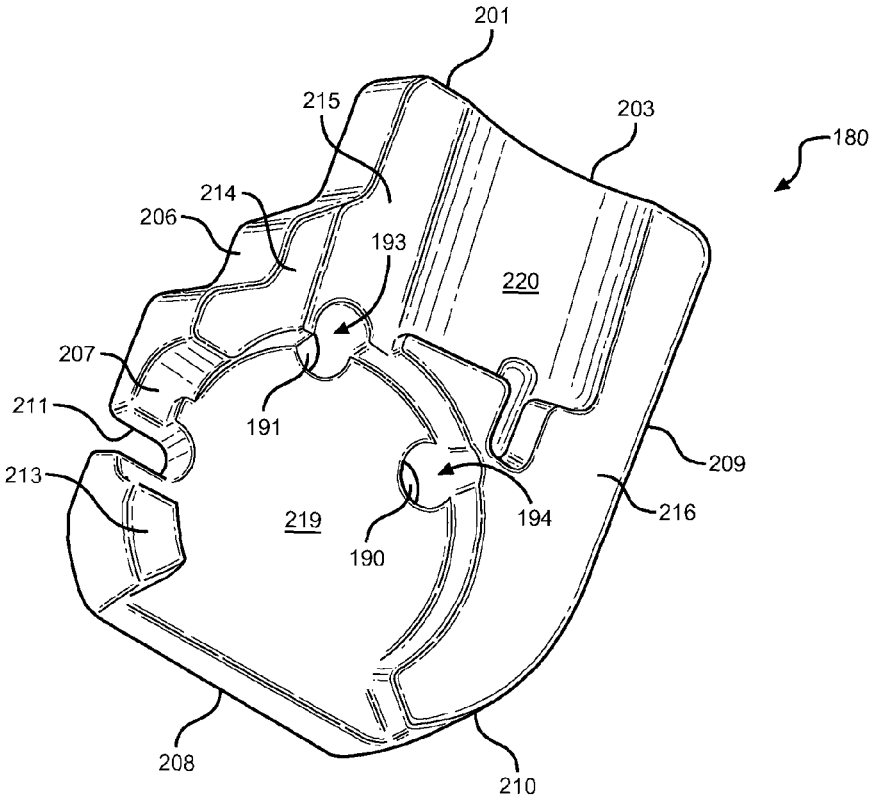
FIG. 7 is a perspective view of a mass damper housing according to the second embodiment.
Figure 8:
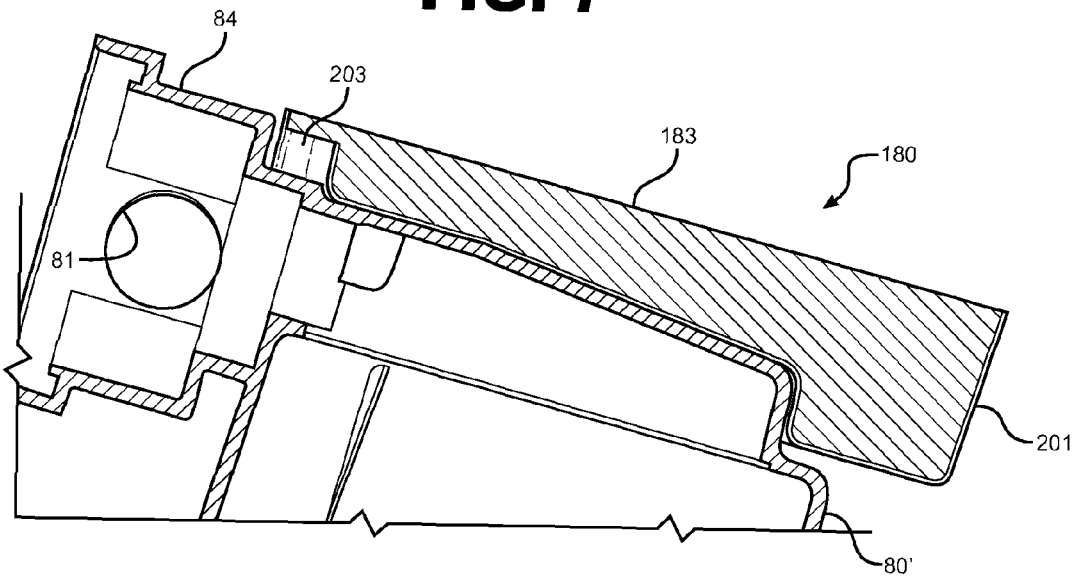
FIG. 8 is a cross-sectional view illustrating the mounting of the mass damper housing in accordance with the second embodiment of the invention.

The concept of conforming to the structure in which it is mounted and providing the mass damping effect desired in accordance with the invention will also become more fully evident in considering the remaining disclosure, starting with a second embodiment shown in FIGS. 6-8. As illustrated, a mass damper housing 180 is shown to include a base 183 and a peripheral side wall 187. Formed in base 183 is a pair of spaced bores 190 and 191 which lead to cavities 193 and 194 that receive posts 197 and 198 extending from sump enclosure 80'. Peripheral side wall 187 is shown to include a straight side wall section 201 formed with an arcuate cut-out portion 203. Straight side wall section 201 leads to an undulating side wall section 206 which is also formed with an arcuate cut-out portion 207. Peripheral side wall 187 also includes side wall sections 208 and 209 which are interconnected by a curvilinear section 210. Shown in undulating side wall section 206 and extending from arcuate cut-out portion 207 is a notch 211. As perhaps best shown in FIG. 7, base 183 includes various raised body portions 213-216 which define plateaus associated with mass damper housing 180. These raised body portions 213 and 216 aid in defining a flat body portion 219 of base 183, as well as a curved body portion 220 of base 183.

As clearly illustrated, mass damper housing 180 is mounted upon and about sump enclosure 80' and adjacent structure. More specifically, posts 197 and 198 are received within cavities 193 and 194 and fasteners 223 and 224 are extended through bores 190 and 191 and threaded into posts 197 and 198. Upon mounting, arcuate cut-out portion 203 extends closely adjacent and conforms to outlet 84 of the sump unit 76, while arcuate cut-out portion 207 closely conforms to secondary outlet 114. At the same time, notch 211 accommodates a post 225 which is molded in order to establish an alignment and mounting aid. At this point, as with the discussion set forth above, it should be readily recognized that mass damper housing 180 is specifically constructed to conform closely to the structure of sump enclosure 80' and about additional portions thereof including associated outlets. FIG. 8 certainly illustrates the significant conformity of mass damper housing 180 to respective portions of the sump unit such that mass damper housing 180 actually directly contacts sump enclosure 80' over a significant portion thereof, such as at flat body portion 219.

Figure 9:
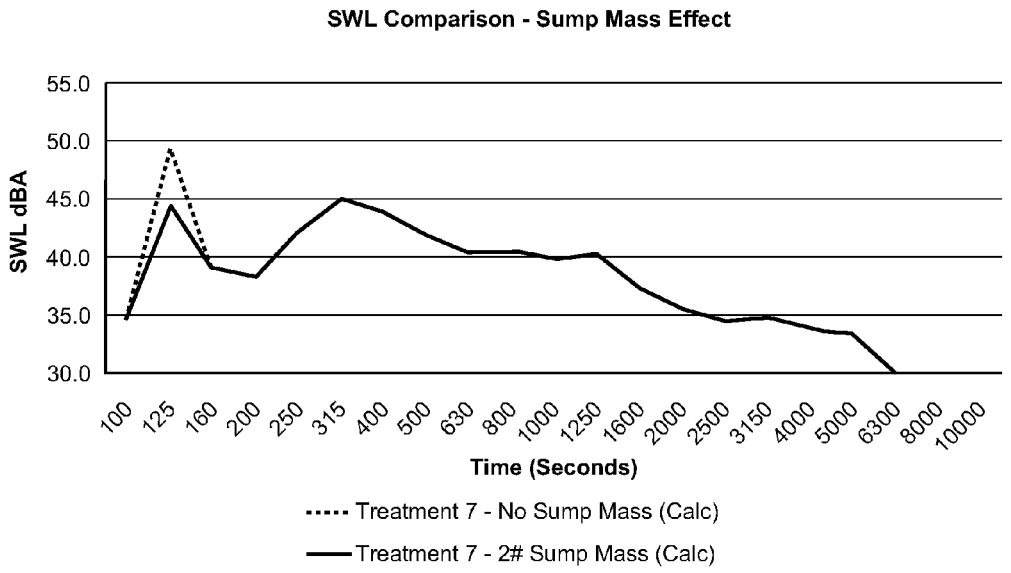
FIG. 9 is a graph illustrating the effect of employing the mass damper housing of the invention during a washing fluid recirculation operation of the dishwasher.
Figure 10:
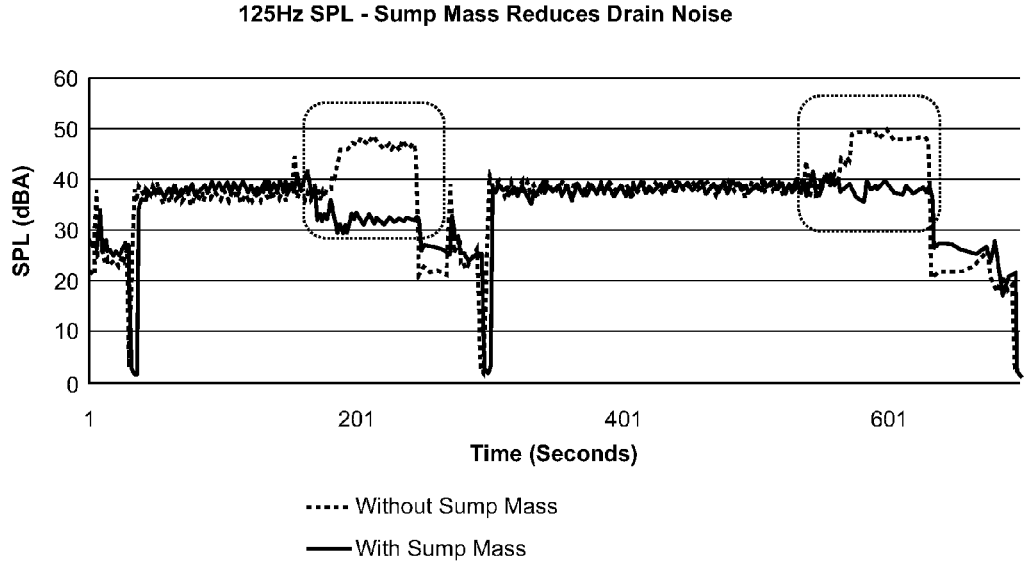
FIG. 10 is a graph illustrating the effect of employing the mass damper housing of the invention during a drain operation of the dishwasher.

As in the case of mass damper housing 130, mass damper housing 180 is also formed of a heavy material, such as concrete, steel, iron or the like, so as to have a significant weight in the range of 1-6 lbs. The inclusion of this additional weighted structure in accordance with the present invention performs a significant mass dampening effect which minimizes the development of vibrations, particularly during certain operational phases of circulation pump unit 88 and drain pump unit 106. The significant reduction of noise is represented in FIGS. 9 and 10 wherein the decibel ranges are significantly reduced in certain operational stages of dishwasher 2. In particular, it was extremely desirous in connection with the invention to maintain noise levels at or below 50 decibels. With the inclusion of the mass damper arrangement of the invention, it was actually surprising to find developed noise levels to be at or below 45 decibels. In fact, FIG. 9 clearly illustrates an approximately 10% reduction in decibel levels at a critical juncture during an initial operational period for the circulation pump unit 88, while FIG. 10 illustrates that the inclusion of the mass damper housing of the invention significantly reduces drain noise through at least two portions of an overall drain operation with about a 20% drop in noise level at each of the 201 and 601 time periods.

Although described with reference to preferred embodiments of the invention, it should be readily understood that various changes and/or modifications can be made to the invention without departing from the spirit thereof. For instance, although shown in connection with a conventional dishwasher having a pivoted front door, it should be readily apparent that the invention can also be applied to other types of dishwashers, including drawer-type dishwashers. In addition, although the material used to make the mass damper and the mounting thereof can vary, it is important that the main body portion of the mass damper substantially conform and be rigidly fixed to a portion of a pump housing which is at a position offset from the pump and motor unit, with the mass damper being weighted to reduce vibrations throughout the dishwasher caused by the operation of the pumping motor unit. Finally, it should be noted that although the preferred embodiments provide separate recirculation and drain pumps, it is widely known in the art to utilize a reversible pump assembly which performs both functions. Still, the mass damper housing would conform to and be mounted offset from that pump and motor unit in accordance with the invention. In general, the invention is only intended to be limited by the scope of the following claims.

What is claimed is:

1. A dishwasher comprising:

a tub having at least bottom, opposing side and rear walls which collectively define a washing chamber adapted to receive soiled kitchenware for cleansing; and a dampened pump assembly including:

a housing including a base and a first mounting port defining a fluid conduit integrated into the base;

a pump and motor unit secured to the housing at the first mounting port, with the pump and motor unit being configured to develop a flow of washing fluid directed through the fluid conduit during operation of the dishwasher; and a mass damper including a main body portion that substantially conforms and is rigidly fixed to a portion of the housing, the main body portion being located at a position offset from the pump and motor unit, wherein the mass damper is weighted to reduce vibrations throughout the dishwasher caused by the operation of the pump and motor unit.

2. The dishwasher according to claim 1, wherein the housing further includes a second mounting port exposed to the fluid conduit and the dampened pump assembly further comprises a drain pump secured to the housing at the second mounting port, the position of said mass damper also being offset from the drain pump, with the mass damper being weighted to reduce vibrations caused by operation of the drain pump.

3. The dishwasher according to claim 1, wherein the main body portion includes a bottom wall and a side wall collectively defining a receiving cavity, with said portion of the housing projecting into the receiving cavity.

4. The dishwasher according to claim 3, wherein said portion of the housing directly abuts the main body portion of the mass damper.

5. The dishwasher according to claim 3, wherein the side wall of the mass damper includes a cut-out portion extending about a section of the fluid conduit.

6. The dishwasher according to claim 1, wherein the mass damper is comprised of concrete.

7. The dishwasher according to claim 1, wherein the mass damper is comprised of steel.

8. The dishwasher according to claim 1, wherein the mass damper has a weight of approximately 1-6 pounds.

9. The dishwasher according to claim 8, wherein the mass damper has a weight of approximately 2-3 pounds.

10. The dishwasher according to claim 1, wherein the bottom of the tub is formed with an opening and the base of the housing is secured to the bottom of the tub such that the housing, at least in part, defines a sump portion of the dishwasher.

11. The dishwasher according to claim 1, wherein the mass damper reduces vibrations throughout a 60-180 Hz range.

12. A dampened pump assembly for use in a dishwasher comprising:

a housing including a base and a first mounting port defining a fluid conduit integrated into the base;

a pump and motor unit secured to the housing at the first mounting port, with the pump and motor unit being configured to develop a flow of washing fluid directed through the fluid conduit; and a mass damper including a main body portion that substantially conforms and is rigidly fixed to a portion of the housing, the main body portion being located at a position offset from the pump and motor unit, wherein the mass damper is weighted to reduce vibrations caused by the operation of the pump and motor unit.

13. The dampened pump assembly according to claim 12, wherein the housing further includes a second mounting port exposed to the fluid conduit and the dampened pump assembly further comprises a drain pump secured to the housing at the second mounting port, the position of said mass damper also being offset from the drain pump, with the mass damper being weighted to reduce vibrations caused by operation of the drain pump.

14. The dampened pump assembly according to claim 12, wherein the main body portion includes a bottom wall and a side wall collectively defining a receiving cavity, with said portion of the housing projecting into the receiving cavity.

15. The dampened pump assembly according to claim 14, wherein said portion of the housing directly abuts the main body portion of the mass damper.

16. The dampened pump assembly according to claim 14, wherein the side wall of the mass damper includes a cut-out portion extending about a section of the fluid conduit.

17. The dampened pump assembly according to claim 12, wherein the mass damper is comprised of concrete.

18. The dampened pump assembly according to claim 12, wherein the mass damper is comprised of steel.

19. The dampened pump assembly according to claim 12, wherein the mass damper has a weight of approximately 1-6 pounds.

20. The dampened pump assembly according to claim 12, wherein the mass damper reduces vibrations throughout a 60-180 Hz range.

* * * * *